US006761436B2

(12) United States Patent
Tobita et al.

(10) Patent No.: US 6,761,436 B2
(45) Date of Patent: Jul. 13, 2004

(54) INKJET HEAD FORMED WITH A PLURALITY OF RESTRICTORS AND INKJET PRINTER INCLUDING THE SAME

(75) Inventors: Satoru Tobita, Hitachinaka (JP); Shinya Tomita, Hitachinaka (JP); Toshitaka Ogawa, Hitachinaka (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 0 days.

(21) Appl. No.: 10/183,422

(22) Filed: Jun. 28, 2002

(65) Prior Publication Data

US 2003/0011662 A1 Jan. 16, 2003

(30) Foreign Application Priority Data

Jul. 6, 2001 (JP) ..... P2001-205731
Mar. 29, 2002 (JP) ..... P2002-094667

(51) Int. Cl.[7] ..... B41J 2/045
(52) U.S. Cl. ..... 347/70
(58) Field of Search ..... 347/68–72, 20, 347/54

(56) References Cited

U.S. PATENT DOCUMENTS 4,697,193 A * 9/1987 Howkins ..... 347/70
4,730,197 A * 3/1988 Raman et al. ..... 347/70
5,512,793 A * 4/1996 Takeuchi et al. ..... 310/328
6,270,203 B1 * 8/2001 Kitahara et al. ..... 347/70
6,502,929 B1 * 1/2003 Tanaka et al. ..... 347/71

FOREIGN PATENT DOCUMENTS

JP 8-290571 11/1996
JP 2727196 12/1997

* cited by examiner

*Primary Examiner*—Stephen D. Meier
*Assistant Examiner*—An H. Do
(74) *Attorney, Agent, or Firm*—Whitham, Curtis & Christofferson, PC

(57) ABSTRACT

An inkjet head is formed with a nozzle, a pressure chamber, a plurality of restrictors, and a common ink chamber. Because the plurality of restrictors are formed in the inkjet head, it is possible to increase a fluid resistance of the restrictors without decreasing the Helmholtz resonant frequency. Accordingly, the inkjet head can be driven at a high frequency while preventing residual pressure wave affecting a subsequent ink ejection.

12 Claims, 6 Drawing Sheets

INKJET HEAD FORMED WITH A PLURALITY OF RESTRICTORS AND INKJET PRINTER INCLUDING THE SAME

BACKGROUND OF THE INVENTION

1. Field of the Invention

The present invention relates to an inkjet printer head that ejects ink droplets through nozzles onto a recording medium to form images thereon.

2. Related Art

FIG. 1 shows a configuration of a conventional inkjet head 101, which is formed with a nozzle 110, a common ink chamber 102, a pressure chamber 103, and a restrictor 106. The pressure chamber 103 is in fluid communication with the nozzle 110 and also with the common ink chamber 102 via the restrictor 106. A diaphragm 104 defines an upper wall of the pressure chamber 103. A piezoelectric element 105 is attached onto the diaphragm 104 for deforming the same. A filter 107 is provided inside the common ink chamber 102 for preventing any foreign materials from entering the pressure chamber 103 and from blocking the nozzle 110.

In this configuration, when a driving voltage is applied, the piezoelectric element 105 changes an internal pressure of the pressure chamber 103 and ejects an ink droplet through the nozzle 110. More specifically, a rising edge of the driving pulse deforms the diaphragm 104 in a direction to increase the volume of the pressure chamber 103, thereby generating a negative pressure in the pressure chamber 103. This negative pressure draws ink from a manifold (not shown) into the pressure chamber 103 through the common ink chamber 102 and the restrictor 106. Then, a lowering edge of the driving pulse releases the deformation of the diaphragm 104 to decrease the volume of the pressure chamber 103 to its initial volume. This increases the internal pressure of the pressure chamber 103 and ejects an ink droplet through the nozzle 110.

There has been increasing demand for an inkjet head that can be driven at a high frequency to eject ink in order to realize an inkjet printer capable of high-speed high-quality printing. One method for increasing the driving frequency is to increase a Helmholtz resonant frequency, which is determined by a dimension of the inkjet head 101 and the like.

Also, Japanese Patent-Application Publication No. HEI-08-290571 has proposed an inkjet head where:

$$0.5<Mn/(Mn+Ms)$$

wherein Mn is an inertance of a nozzle; and

Ms is an inertance of a restrictor.

By setting the relationship between the nozzle and the restrictor in this manner, it is possible to eject spherical ink droplets regardless of high driving frequency.

SUMMARY OF THE INVENTION

However, mere the above relationship between the inertance of the nozzle and that of the restrictor does not solve the following problems. That is, when the pulse width of the driving pulse, i.e., the time duration from when the pressure chamber volume is increased until when the increased volume is reduced to its initial volume, is shortened in order to increase the driving frequency, only insufficient amount of ink may be drawn into the pressure chamber before ejecting the ink droplet due to delay in ink introduction by means of inertial, causing improper ink ejection. On the other hand, elongating the driving pulse width in order to introduce sufficient amount of ink into the pressure chamber sacrifices a frequency respond time. Moreover, high-frequency driving adversely increases the residual pressure vibration of a meniscus, which in turn fluctuates ink ejection speed. In worse cases, ink will not be ejected.

It is an object of the present invention to overcome the above problems and also to provide an inkjet head capable of performing stable ink ejection at a high frequency.

In order to achieve the above and other objects, there is provided an inkjet head including a body and a diaphragm. The body is formed with a nozzle, a pressure chamber in a fluid communication with the nozzle, a plurality of restrictors, and a common ink chamber. The common ink chamber supplies an ink to the pressure chamber via the restrictors. The diaphragm defines a wall of the pressure chamber. Each restrictor has an opening facing to the diaphragm.

There is also provided an inkjet head including a body and a diaphragm. The body is formed with a nozzle, a pressure chamber in a fluid communication with the nozzle, a plurality of restrictors, and a common ink chamber. The common ink chamber supplies an ink to the pressure chamber via the restrictors. The diaphragm defines a wall of the pressure chamber. The body includes a restrictor plate formed with the plurality of restrictors. The restrictor plate faces to the diaphragm.

Further, there is provided an inkjet printer including an inkjet head. The inkjet head includes a body and a diaphragm. The body is formed with a nozzle, a pressure chamber in a fluid communication with the nozzle, a plurality of restrictors, and a common ink chamber. The common ink chamber supplies an ink to the pressure chamber via the restrictors. The diaphragm defines a wall of the pressure chamber. Each restrictor has an opening facing to the diaphragm.

PREFERRED EMBODIMENT OF THE PRESENT INVENTION

Next, an inkjet head according to an embodiment of the present invention will be described while referring to the attached drawings.

Figure 4:
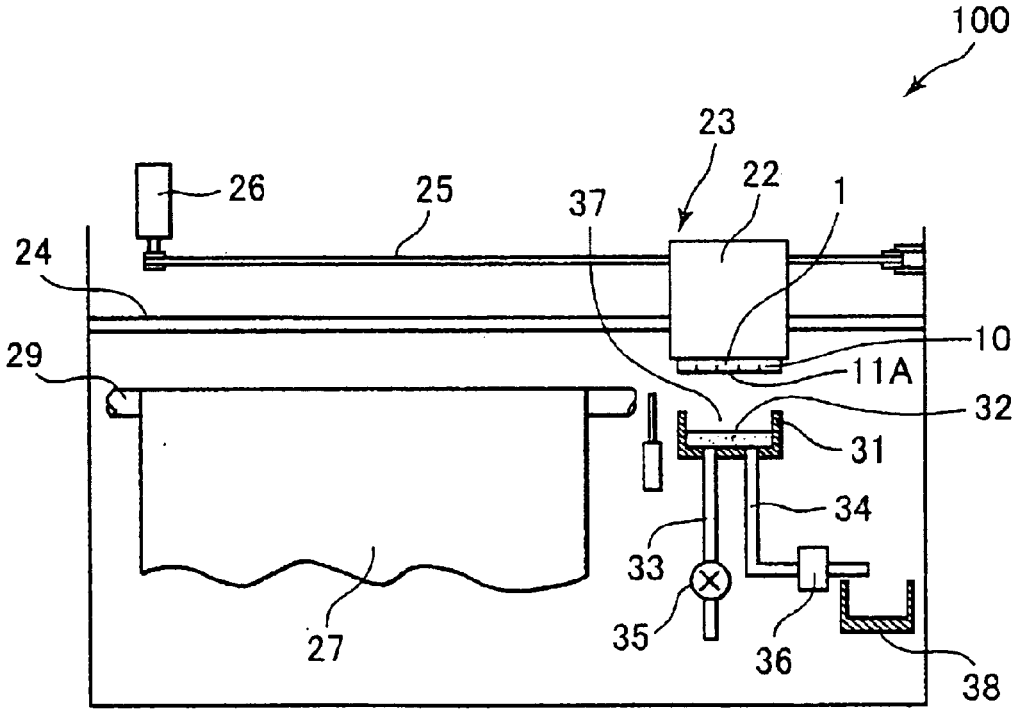
FIG. 4 is a plan view of an inkjet printer including an inkjet head according to an embodiment of the present invention.

FIG. 4 shows a general configuration of an inkjet printer 100 including an inkjet head 1 according to the present embodiment. The inkjet head 1 of the present embodiment includes a nozzle surface 11A formed with a plurality of nozzles 10. The inkjet printer 100 includes a head unit 23 that mounts the inkjet head 1 and an ink cartridge 22. The head unit 23 is slidingly supported by a guide shaft 24 and connected to a power-transmitting member 25. The head unit 23 is reciprocally moved along the guide shaft 24 by a driving power transmitted from a driving power source 26. The ink cartridge 22 supplies ink to the inkjet head 1.

A transfer roller 29 transports a recording sheet 27 in a direction perpendicular to a direction in which the head unit 23 reciprocally moves. The inkjet head 1 ejects based on recording signals ink droplets through the nozzles 10 toward the recording sheet 27.

The inkjet printer 100 also includes a capping member 31 formed of resilient material, such as rubber. When a recording operation is not performed, the head unit 23 moves to a position above the capping member 31, and the capping member 31 covers over the nozzle surface 11A of the inkjet head 1. An ink absorbing sheet 32 is provided in an internal space 37 of the capping member 31 for facilitating ink suction operation and for moisturizing air in the internal space 37.

A pair of tubes 33, 34 is connected to the bottom of the capping member 31. The tube 33 is connected to an air valve 35, and the tube 34 is connected to a waste-ink chamber 38 via a suction pump 36 that generates a negative pressure. The negative pressure generated when the air valve 35 is closed draws ink out of the inkjet head 1 into the internal space 37 of the capping member 31, whereas the negative pressure generated when the air valve 35 is open discharges ink inside the internal space 37 to the waste-ink chamber 38.

Figure 5:
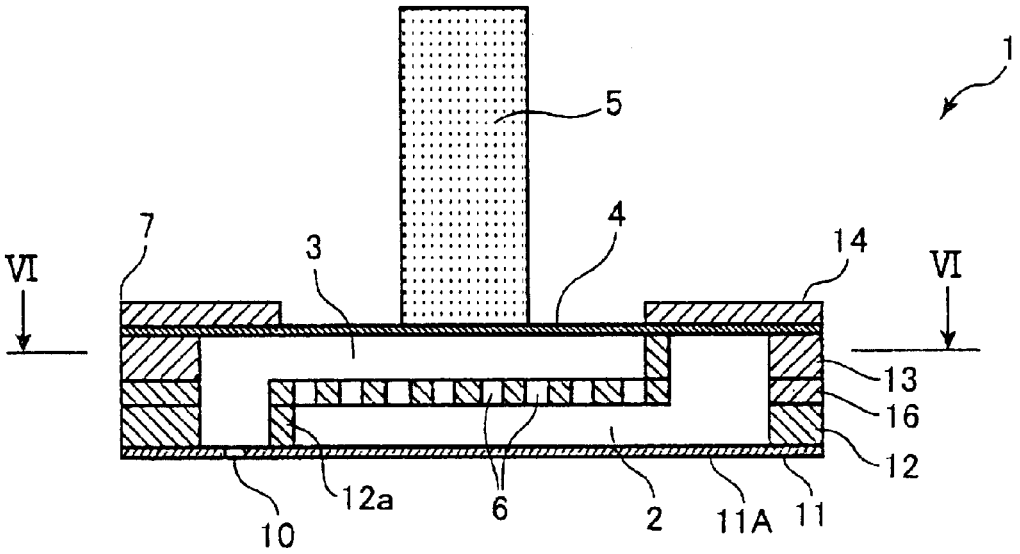
FIG. 5 is a cross-sectional view of the inkjet head according to the embodiment of the present invention.
Figure 6:
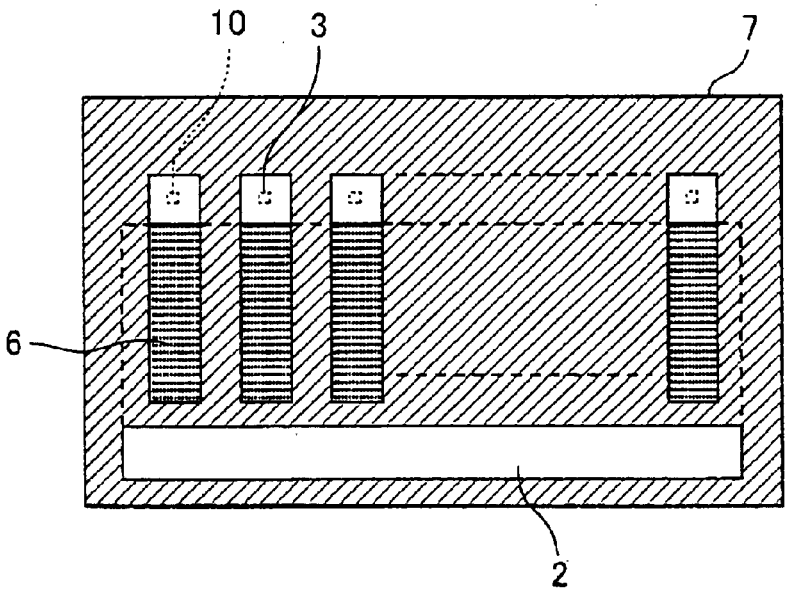
FIG. 6 is a cross-sectional view taken along a line VI—VI of FIG. 5.

Next, description of the inkjet head 1 according to the present embodiment will be provided. As shown in FIGS. 5 and 6 the inkjet head 1 includes a body 7 formed with the plurality of nozzles 10, a plurality of pressure chambers 3, a common chamber 2, and a plurality of restrictors 6. Each pressure chamber 3 is in fluid communication with the corresponding nozzle 10. The common ink chamber 2 extends beneath the pressure chambers 3 and fluidly connected to all the pressure chambers 3 via the restrictors 6. Although not shown in the drawings, the common ink chamber 2 is fluidly connected to an ink tank from which ink is supplied to the common ink chamber 2. In the present embodiment, each nozzle 10 has a circular cross section with a diameter of 30 $\mu$m.

The body 7 includes a laminated structure formed of a plurality of thin plates, which includes a nozzle plate 1, a first chamber plate 12, a restrictor plate 16, a second chamber plate 13, a diaphragm 4, and a support plate 14. These parts are stacked and fixed one on the other in this order. The thin plates could be formed of monocrystalline material, such as silicon. The diaphragm 4 defines an upper wall of the pressure chamber 3. A piezoelectric element 5 is attached onto the diaphragm 4 for selectively deforming the same.

The nozzle plate 1, the first chamber plate 12, the restrictor plate 16, and the second chamber plate 13 are formed with one or more through holes serving as either the nozzle 1, the common ink chamber 2, the pressure chamber 3, the restrictors 6 or the like. More specifically, the nozzle plate 1 is formed with the plurality of nozzles 10. The first chamber plate 12 is formed with through holes serving as most part of the common ink chamber 2 and a portion of the pressure chambers 3. The restrictor plate 16 is formed with a plurality of restrictors 6 and through holes serving as a portion of the common ink chamber 2 and a portion of the pressure chambers 3. The second chamber plate 13 is formed with through holes serving as most part of the pressure chambers 3 and a portion of the common ink chamber 2.

These through holes are formed in the thin plates by etching, so that an inexpensive inkjet head 1 is provided. The thin plates could be formed of a film-shaped photosensitive resin or metal plates rather than monocrystalline material. Alternatively, a combination of any of the film-shaped photosensitive resin, the metal plates, and the monocrystalline thin plates could be used in order to further reduce the production costs.

Because the restrictors 6 are formed in the thin-thickness restrictor plate 16, the common ink chamber 2 can be formed beneath the pressure chamber 3 which has conventionally been a dead space. This is advantageous for providing a compact-sized inkjet head and for highly integrating the nozzles.

Also, because the restrictor plate 16 is placed parallel to the diaphragm 4, the all the restrictors 6 can have the same dimension. This simplifies the production process for forming the restrictors 6 in the restrictor plate 16 and for positioning the restrictor plate 16.

The region to form the restrictors 6 in the restrictor plate 16 could be the entire region or a portion of the region that confronts the diaphragm 4.

With this configuration, it is possible to increase a holtz resonant frequency with a resultant increase in driving frequency of the inkjet head 1 while maintaining a stable ink ejection performance because a fluid resistance Rn of the restrictors 6 can be increased without increasing an inertance Mr of the restrictors 6. Detailed description for this will be described below while referring to the conventional inkjet head 101 and the inkjet head 1 of the present embodiment.

As mentioned above, the driving frequency of inkjet heads increases when the Helmholtz resonant frequency increases. Here, the Helmholtz resonant frequency f of the conventional inkjet head 101 is expressed by the following formula:

$$f=\tfrac{1}{2}\pi\sqrt{\{(Mn+Mr)/((Cc+Cd)(Mn\times Mr))\}} \quad (1)$$

wherein, Cc is a compliance relating to the ink inside the pressure chamber 103;

Cd is a compliance relating to each wall defining the pressure chamber 103;

Mn is an inertance of the nozzle 110; and

Mr is an inertance of the restrictor 106.

As will be understood from the above formula (1), when the inertance Mn and inertance Mr are small, the Helmholtz resonant frequency f increases with a resultant increase in the driving frequency of the inkjet head 101. Needless to say, the driving frequency is low when the inertance Mn and inertance Mr are large.

However, when ejecting ink at a high frequency, residual vibration of a meniscus due to previous ink ejection adversely affects properties of a subsequent ink droplet, such as ejection speed. In worse cases, ink ejection becomes impossible. Accordingly, in order to achieve proper ink ejection at a high frequency, it is necessary to suppress the residual vibration of the meniscus. Here, the residual vibration of the meniscus is small when a fluid resistance Rr of the restrictor 106 is large according to a formula: $\tau=2\times(M/R)$, wherein $\tau$ is a time constant of a vibration (attenuation time) calculated by a lumped constant circuit in sound model, M is an inertance of a passage, and R is a fluid resistance of the passage.

The fluid resistance Rr of the restrictor 106 is in turn determined by the dimension of the restrictor 106. Specifically, the inertance Mr per unit length and the fluid resistance Rr per unit length of an ink passage having a circular cross section are obtained in the formulas:

$$Mr=\rho/(\pi\times d^2)\times 4/3 \quad (2)$$

$$Rr=128\,\mu u/(i\,\pi\times d^4) \quad (3)$$

wherein ρ is ink density;

μ is ink viscosity; and d is a diameter of the ink passage.

That is, when a radius of the restrictor 106 is set small in order to suppress the residual vibration, the fluid resistance Rr of the restrictor 106 increases with a resultant increase in the inertance Mr and, therefore, decrease in the Helmholtz resonant frequency f, i.e., the driving frequency of the inkjet head 101.

Accordingly, in this case also, it is impossible to achieve both the high driving frequency and proper ink ejection at the same time.

Here, a ratio between Mr and Mn is set as a ratio a, and a ratio between Rr and Rn is set as a ratio b. That is:

$$a=Mr/Mn \quad (4)$$

$$b=Rr/Rn \quad (5)$$

There has been confirmed that it is preferable for stabilizing an ink ejection frequency response that the ratio a be greater than 0.5 and smaller than 2.0 and that the ratio b be greater than 4.0 and smaller than 16.0. That is:

$$0.5<a<2.0 \quad (6)$$

$$4.0<b<16.0 \quad (7)$$

Replacing a constant component to A, the above formula (2) is expressed by the formula;

$$Mr=A\times(1/d)^2 \quad (8)$$

Similarly, replacing a constant component to B, the above formula (3) is expressed by the formula;

$$Rr=B\times(1/d)^4 \quad (9)$$

Accordingly, the inertance Mn of the nozzle 10 (110) the inertance Mr of the restrictor 6 (106), the fluid resistance Rn of the nozzle 10 (110), and the fluid resistance Rr of the restrictor 6 (106) are obtained by the formulas:

$$Mn=A\times(1/dn)^2 \quad (10)$$

$$Mr=A\times(1/dr)^2 \quad (11)$$

$$Rn=B\times(1/dn)^4 \quad (12)$$

$$Rr=B\times(1/dr)^4 \quad (13)$$

wherein dn is the diameter of the nozzle 10 (110) (hereinafter referred to as "nozzle diameter"); and dr is the diameter of the restrictor 6 (106) (hereinafter referred to as "restrictor diameter").

From the formulas (40), (10), and (11), a following formula (14) is obtained:

$$a=(dn/dr)^2 \quad (14)$$

Similarly, from the formulas (5), (12), and (13), a following formula (15) is obtained:

$$b=(dn/dr)^4 \quad (15)$$

Figure 7:
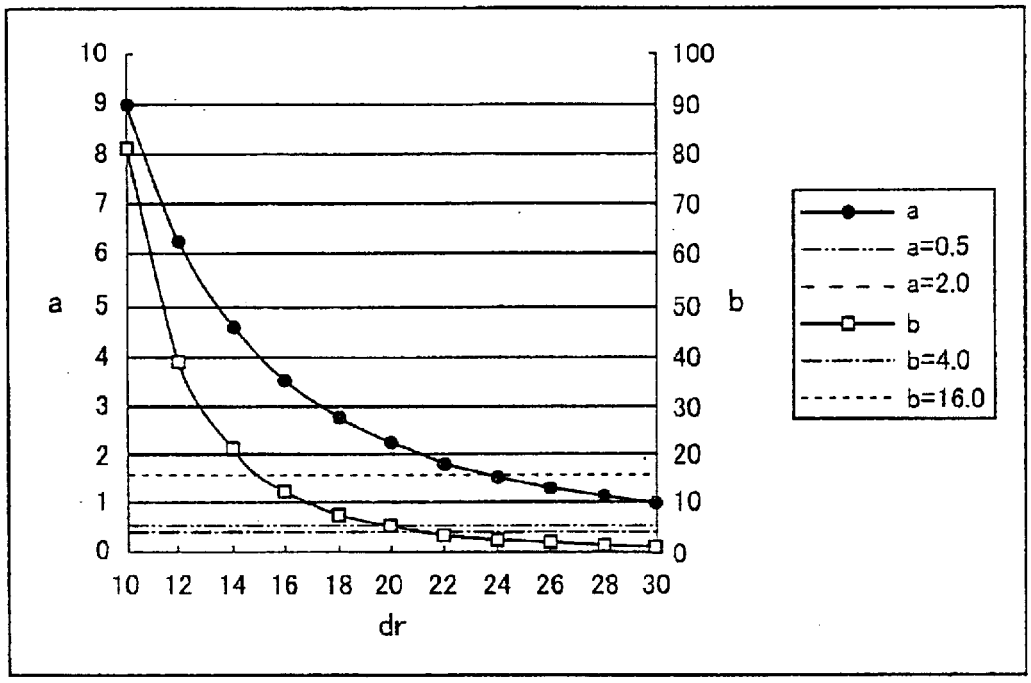
FIG. 7 is a graph showing a ratio a and a ratio b when a nozzle diameter dn is 30 $\mu$m.

FIG. 7 shows a graph showing the ratio a and the ratio b when the nozzle diameter dn is set to 30 μm. The X axis represents the restrictor diameter dr. The left Y axis represents the value of the ratio a, and the right Y axis represents the value of the ratio b. From the graph in FIG. 7, it is understood that a range of the restrictor diameter dr that satisfies the formula (6), i.e., 0.5<a<2.0, is between 21 and 30 (21<dr<30). Also, a range of the restrictor diameter dr that satisfies the formula (7), i.e., 4.0<b<16.0, is between 15 and 21 (15<dr<21). Accordingly, there is no restrictor diameter dr that satisfies both the above formulas (6) and (7) when the nozzle diameter dn is set to 30 μm.

Figure 11:
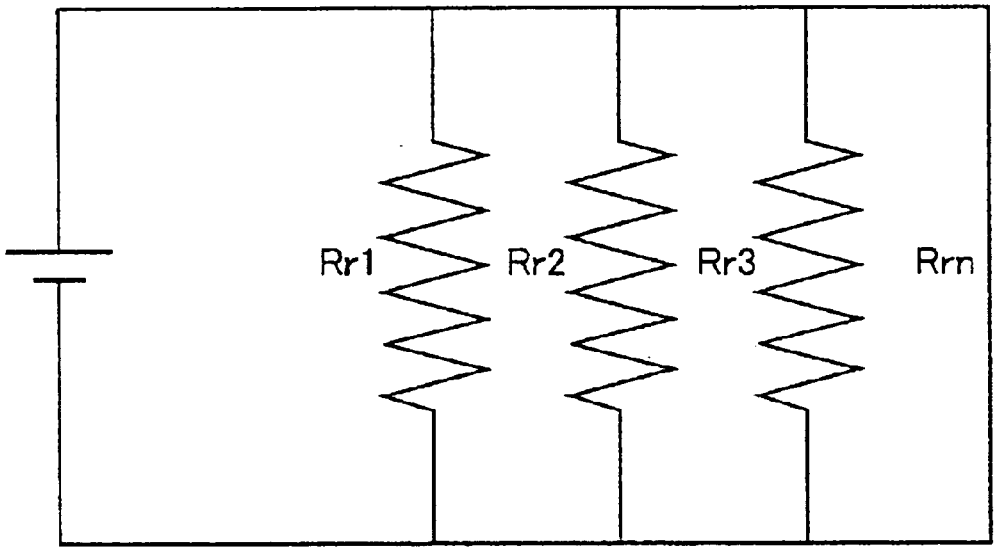
FIG. 11 is a circuit including a plurality of resistance.

Here, FIG. 11 shows a circuit including a plurality of resistances arranged in parallel. A combined resistance Rr' of the plurality of restrictors 6 is expressed in the same manner as a combined resistance in the circuit shown in FIG. 11, that is, the combined resistance Rr' is expressed by a formula (16):

$$1/Rr'=1/Rr1+1/Rr2+1/Rr3+\ldots+1/Rrn \quad (16)$$

Here, all the resistances Rr1, Rr2, . . . , Rrn are equal, that is, $$Rr1=Rr2=Rr3=\ldots=Rrn \quad (17)$$

From the formulas (16) and (17), a formula (18) is obtained.

$$R'=Rrn/n \quad (18)$$

Figure 12:
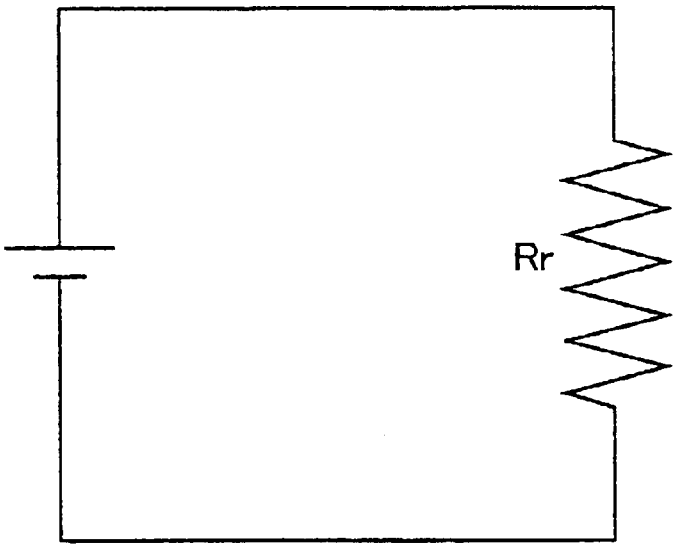
FIG. 12 is an equivalent circuit of the circuit of FIG. 11.

FIG. 12 shows an equivalent circuit of the circuit in FIG. 11. The same is true for the inertance of the restrictors 6. Accordingly, a combined inertance Mr' and a combined resistance Rr' of N restrictors 6 are:

$$Mr'=Mr/N \quad (19)$$

$$Rr'=Rr/N \quad (20)$$

According to the formulas (4), (10), (11), and (19), a ratio a' between the combined inertance Mr' and the inertance Mn is expressed by a formula:

$$a'=(dn/dr)^2/N \quad (21)$$

Similarly, according to the formulas (5), (12), (13) and (20), a ratio b' between the combined restrictor resistance Rr' and the nozzle resistance Rn is expressed by a formula:

$$b'=(dn/dr)^4/N \quad (22)$$

Figure 8:
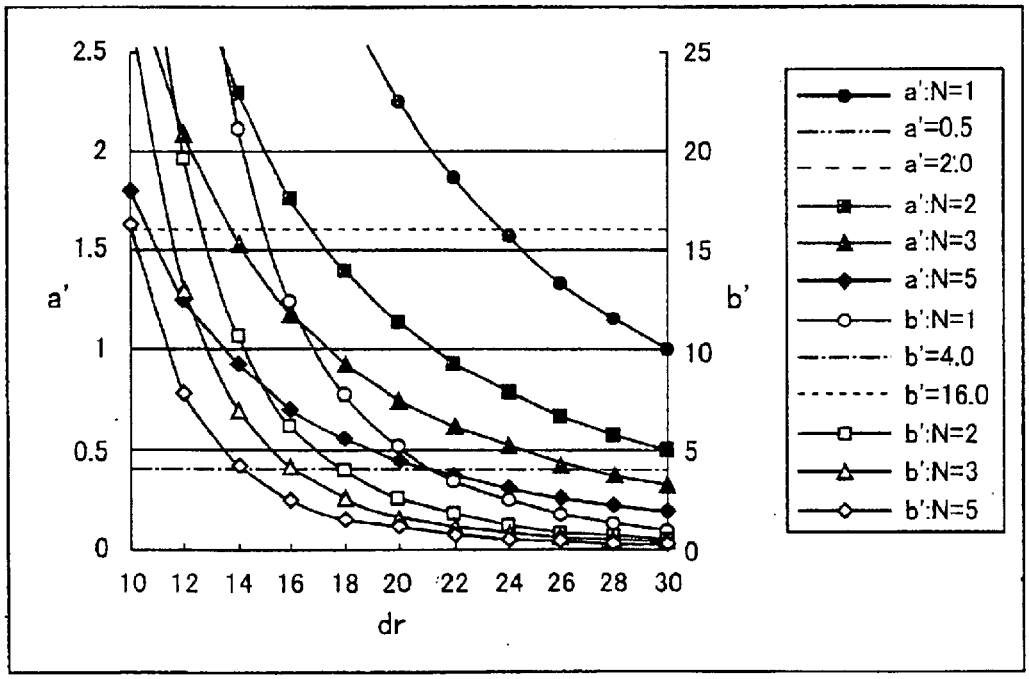
FIG. 8 is a graph showing a ratio a' and a ratio b' when a number N of restrictors is increased.

FIG. 8 is a graph showing the ratios a' and b' when the number N of the restrictors 6 is 1, 2, 3, and 5 (N=1, 2, 3, 5).

TABLE T1

| | N = 1 | N = 2 | N = 3 | N = 5 |
|---|---|---|---|---|
| 0.5 < a' < 2.0 | 20 ~ < 30 | 15 ~ 30 | 12 ~ 24 | 10 ~ 19 |
| 4.0 < b' < 16.0 | 15 ~ 21 | 13 ~ 18 | 12 ~ 16 | 10 < ~ 14 |
| common range | — | 15 ~ 18 | 12 ~ 16 | 10 ~ 14 |

Table T1 shows regions, obtained from the graph in FIG. 8, of the restrictor diameter dr that satisfy the formula (6), the formula (7), and both the formulas (6) and (7).

As will be understood from the table T1, when N=2, 3, 5, there are restrictor diameters dr that satisfy both the formulas (6) and (7). By changing the number N of the restrictors 6, a desired common range can be selected.

Figure 1:
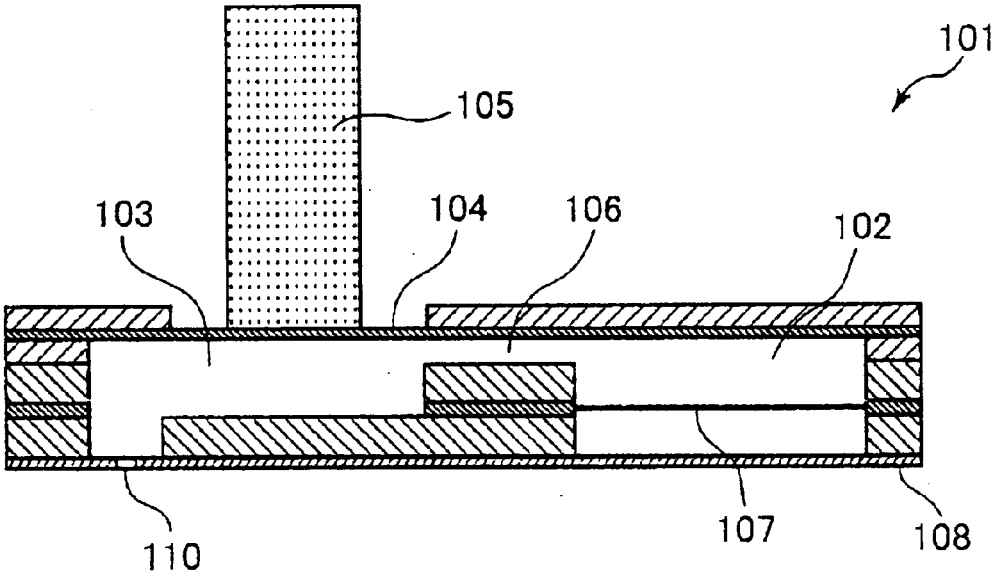
FIG.1 RELATED ART
FIG. 1 is a cross-sectional view of a conventional inkjet head.

Here, as shown in FIG. 5, the inkjet head 1 does not include a filter inside the common ink chamber 2 in contrast to the conventional inkjet head 101 shown in FIG. 1 that includes the filter 107. This is because the restrictors 6 serve as a filter as well as restrictors. In order to prevent blockage of the nozzle 10 due to foreign materials entering passing through the restrictors 6, a ratio κ between the restrictor diameter dr and the nozzle diameter dn (κ=dr/dn) is preferably ½ or less, and further preferably ⅓ or less.

Figure 9:
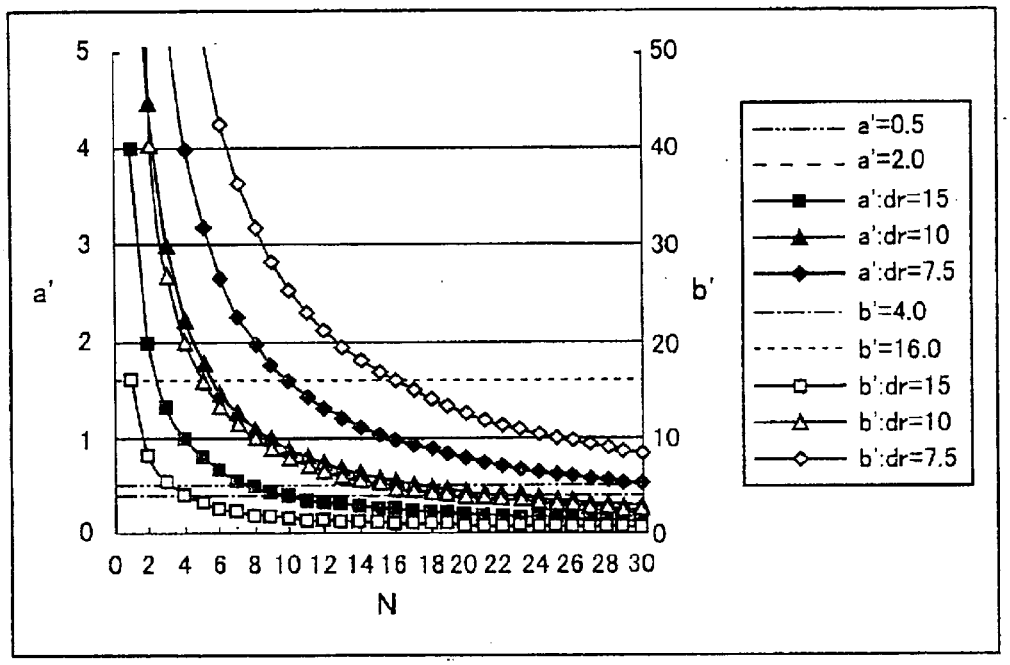
FIG. 9 is a graph showing the ratio a' and the ratio b' when a restrictor diameter is 15 $\mu$m, 10 $\mu$m, and 7.5 $\mu$m.

FIG. 9 is a graph showing the ratios a' and b' when the restrictor diameter dr is set to 15 μm, 10 μm, and 7.5 μm. The X axis represents the number N of the restrictors 6. The left Y axis represents the value of the ratio a', and the right Y axis represents the value of the ratio b'.

TABLE T2

| | dr = 15 μm | dr = 10 μm | dr = 7.5 μm |
|---|---|---|---|
| 0.5 < a' < 2.0 | 2 ~ 8 | 5 ~ 18 | 8 ~ 30 |
| 4.0 < b' < 16.0 | 1 ~ 4 | 5 ~ 19 | 16 ~ 30< |
| common range | 2 ~ 4 | 5 ~ 18 | 16 ~ 30 |

Table T2 shows the numbers N that satisfies the formula (6), the formula (7), and both the formulas (6) and (7), according to the graph in FIG. 9.

As will be understood from the table T2 and the formulas (21) and (22), when the nozzle diameter dn is 30 μm, and when the restrictor diameter dr is set to 7.5 μm, which is less than one third of the nozzle diameter dn of 30 μm, a maximum number Nmax and a minimum number Nmin of the number N of restrictors 6 that satisfies both the formulas (6) and (7) is 30 and 16, respectively. Therefore, there are 15 possible nozzle numbers N that can be used, i.e., N=14 to N=30 (hereinafter number of the possible nozzle numbers N will be referred to as "number N'", i.e., N'=15 in this case). On the other hand, when the restrictor diameter dr is 10 μm and 15 μm, the number N' is 14 and 3, respectively, which are less than when the nozzle diameter dr is set to 7.5 μm. That is, smaller restrictor diameter dr increases the number N', providing more choices of the number N of the restrictors 6, and moreover, enhances a filtering function of the restrictors 6.

Figure 10:
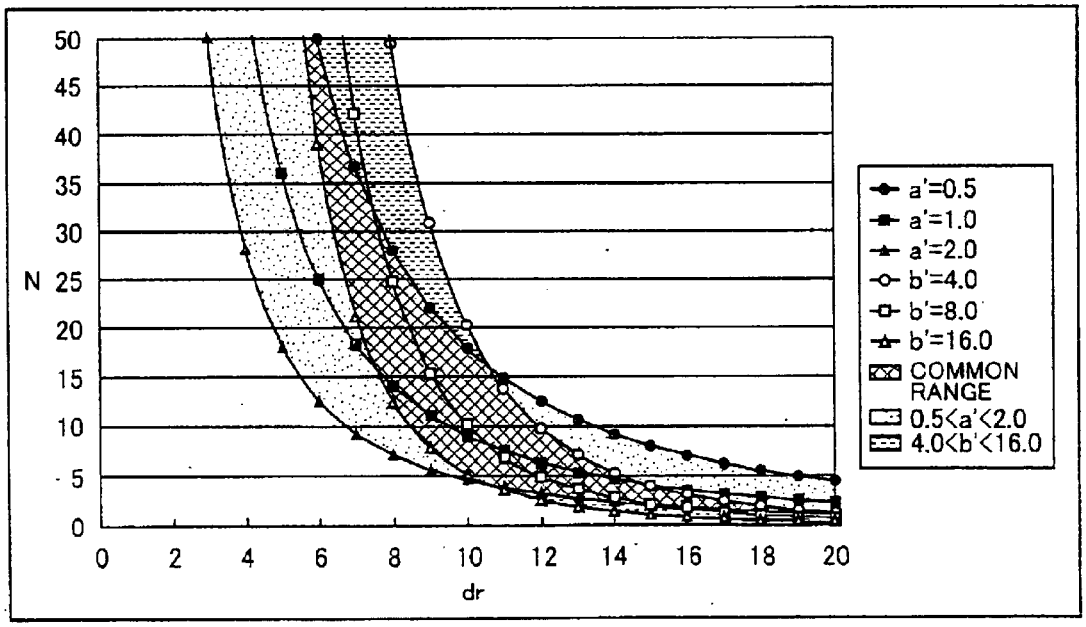
FIG. 10 is a graph showing the number N when the restrictor diameter is changed.

FIG. 10 is a graph showing the ratio a' that satisfies the formula (6), the ratio b' that satisfies the formula (7), and a common range that satisfies both the formulas (6) and (7), when the nozzle diameter dn is 30 μm. The X axis represents the restrictor diameter dr, and the Y axis represents the number N of the restrictors 6. As shown in FIG. 10, because the curves of the ratios a' and b' are curves of the second order and fourth order, these curves intersect at some points, and a ratio (Nmax/Nmin) takes maximum value. A practical range of the ratio Nmax/Nmin is preferably 2~3. If the ratio Nmax/Nmin is less than 2, filtering function of the restrictors 6 will be insufficient. On the other hand, if the ratio Nmax/Nmin is more than 3, the size of the restrictors 6 will be so small, and it will be difficult to form such small-sized restrictors 6.

It should be noted that although in the above explanation was provided assuming that the nozzle 10 and the restrictor 6 have a circular cross section, the nozzle 10 and the restrictor 6 can have a rectangular cross section or any other cross section. In this case, an equivalent diameter of the passage is obtained and used in the above described calculation method. Also, the above explanation is provided for an ink passage per unit area. However, the above is true for when the length of the restrictor 6 is shortened. Here, it is important not to change the inertance Mr and the fluid resistance Rr even when the length of the restrictor 6 is changed. In order to shorten the length of the restrictor 6 without changing the inertance Mr and the fluid resistance Rr, it is necessary to decrease the diameter dr of the restrictor 6 as will be understood from the formulas (2) and (3). Decrease in the diameter dr results in increase in the number N as will be understood from the above example shown in the table T1, and thus the number N' is increased, which is advantageous.

Figure 2:
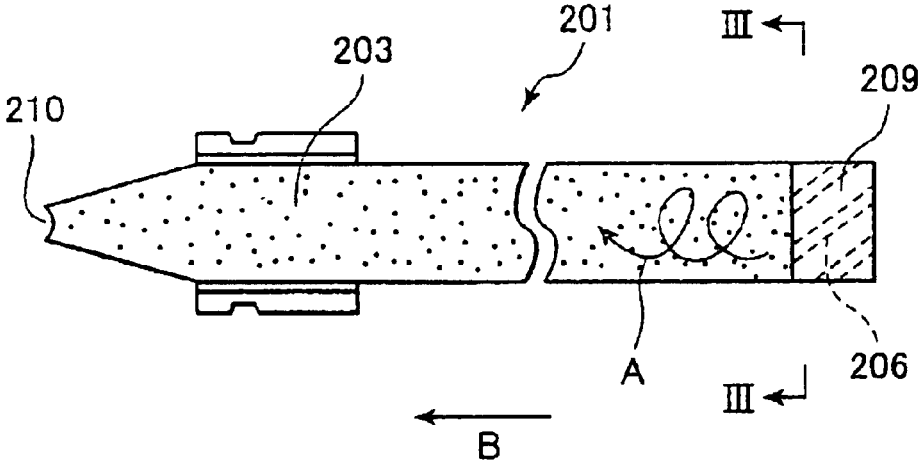
FIG.2 RELATED ART
FIG. 2 is a cross-sectional view of another conventional inkjet head.
Figure 3:
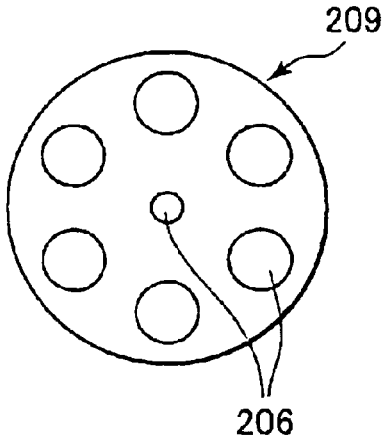
FIG.3 RELATED ART
FIG. 3 is a cross-sectional view of a filter of the another conventional inkjet head taken along a line III—III of FIG. 2.

Here, Japanese Patent No. 2727196 discloses an inkjet head 201 shown in FIG. 2, wherein a filter 209 formed with a plurality of spiral-shaped ink passages 206 is positioned upstream side of a pressure chamber 203. FIG. 3 shows a cross-sectional view taken along a line III—III of FIG. 2. This configuration makes ink flow in a whirl as indicated by an arrow A during purging operation, thereby facilitating purging operation. In this configuration, however, a region to form the plurality of ink passages 206 may have only a limited dimension equivalent to the cross-sectional dimension of the pressure chamber 203 perpendicular to the ink flow direction indicated by an arrow B. Also, the number of the ink passages 206 is as small as four through ten, so that smooth ink flow into the pressure chamber 203 may be prevented. Further, there must be a good balance between the fluid resistance of a nozzle 210 and the fluid resistance of the ink passages 206. Foreign materials clinging on the ink passages 206 will break this good balance and cause improper ink ejection. Moreover, in order to realize proper ink ejection, the filter 209 should be provided at a precise position. Otherwise, the dimension of the pressure chamber 206 changes and affects on ejection performance. However, it is relatively difficult to position the filter 209 in such a precise position.

On the other hand, according to the above-described embodiment of the present invention, the restrictor plate 16 is placed parallel to the diaphragm 4, i.e., the ink flow direction, the surface area of the restrictor plate 6 can be larger than the cross-sectional dimension of the pressure chamber 3 with respect to a direction perpendicular to the ink flow direction inside the pressure chamber 3, realizing smooth ink flow from the common ink chamber 2 to the pressure chamber 3. Also, because the restrictor plate 16 is formed of a thin plate laminated between the chamber plates 12, 13, the restrictor plate 16 can be accurately positioned in a relatively easy manner without affecting the dimension of the pressure chamber 3. Moreover, slight displacement of the restrictor plate 16 will hardly affect the ink ejection performance of the inkjet head 1 since the positioning of the restrictor plate 16 does not determine the dimension (length in the ink flow direction) of the pressure chamber 3.

While some exemplary embodiments of this invention have been described in detail, those skilled in the art will recognize that there are many possible modifications and variations which may be made in these exemplary embodiments while yet retaining many of the novel features and advantages of the invention.

For example, in the above described embodiment, the restrictor plate 16 is placed parallel to the diaphragm 4. However, the restrictor plate 16 could be angled with respect to the diaphragm 4 to increase the surface area of the restrictor plate 16. In this case, however, restrictors 6 need to have different dimensions depending on their location.

Although the restrictors 6 of the above embodiment are formed only in a single plane of the restrictor plate 16, restrictors could be formed in a partitioning wall 12*a* (FIG. 5) between the common ink chamber 2 and the pressure chamber 3 to further increase the surface area of the restrictors. In this case, however, further consideration is necessary for the dimensions of these additional restrictors.

What is claimed is:

1. An inkjet head comprising;

a body formed with a pressure chamber with a corresponding nozzle, and a common ink chamber, the pressure chamber being fluidly connected to the common ink chamber by a plurality of restrictors the common ink chamber supplying an ink to the pressure chamber via the plurality of restrictors; and a diaphragm defining a wall of the pressure chamber, wherein each of the plurality of restrictors has an opening facing to the diaphragm.

2. The inkjet head according to claim 1, wherein the body includes a restrictor plate formed with the plurality of restrictors, the restrictor plate extending substantially parallel to the diaphragm.

3. The inkjet head according to claim 1, further comprising a piezoelectric member attached to the diaphragm in a manner that the diaphragm interposes between the piezoelectric member and the pressure chamber, the piezoelectric member selectively deforming the diaphragm to change internal pressure of the pressure chamber.

4. The inkjet head according to claim 1, wherein a ratio Nmax/Mmin is between 2 and 3, wherein Nmax and Mmin are maximum and minimum numbers of the plurality of restrictors, respectively, that satisfy both $0.5<a<2.0$ and $4.0<b<16.0$; wherein a is a ratio Mr/Mn, wherein Mr is a combined inertance of the plurality of restrictors; and Mn is an inertance of the nozzle; and b is a ratio Rr/Rn, wherein, Rr is a combined fluid resistance of the plurality of restrictors; and Rn is a fluid resistance of the nozzle.

5. The inkjet head according to claim 1, further comprising a restrictor plate formed with the restrictors, the restrictor plate being provided between the pressure chamber and the common ink chamber and defining one surface of the pressure chamber and one surface of the common ink chamber.

6. The inkjet head according to claim 1, wherein the body is formed from a plurality of film-shaped members laminated one on the other.

7. The inkjet head according to claim 1, wherein the body is formed from a plurality of metal plates laminated one on the other.

8. The inkjet head according to claim 1, wherein the body is formed with the nozzle, the pressure chamber, the restrictors, and the common ink chamber by etching technique.

9. The inkjet head according to claim 1, wherein a diameter of each restrictor is less than one half of a diameter of the nozzle.

10. An inkjet head comprising;

a body formed with a pressure chamber with a corresponding nozzle, and a common ink chamber, the pressure chamber being fluidly connected to the common ink chamber by a plurality of restrictors, the common ink chamber supplying an ink to the pressure chamber via the plurality of restrictors; and a diaphragm defining a wall of the pressure chamber, wherein the body includes a restrictor plate formed with the plurality of restrictors, the restrictor plate facing to the diaphragm.

11. An inkjet printer comprising:

an inkjet head including:

a body formed with a pressure chamber with a corresponding nozzle, and a common ink chamber, the pressure chamber being fluidly connected to the common ink chamber by a plurality of restrictors, the common ink chamber supplying an ink to the pressure chamber via the plurality of restrictors; and a diaphragm defining a wall of the pressure chamber, wherein each of the plurality of restrictors has an opening facing to the diaphragm.

12. The inkjet head according to claim 11, wherein the body of the inkjet head includes a restrictor plate formed with the plurality of restrictors, the restrictor plate extends substantially parallel to the diaphragm.

* * * * *